US007207648B2

(12) United States Patent
Kojima et al.

(10) Patent No.: US 7,207,648 B2
(45) Date of Patent: Apr. 24, 2007

(54) INKJET HEAD AND METHOD OF CLEANING INKJET HEAD

(75) Inventors: Toshiya Kojima, Kanagawa (JP); Kenichi Kodama, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 285 days.

(21) Appl. No.: 10/936,657

(22) Filed: Sep. 9, 2004

(65) Prior Publication Data

US 2005/0057601 A1 Mar. 17, 2005

(30) Foreign Application Priority Data

Sep. 12, 2003 (JP) ..... 2003-321667

(51) Int. Cl.
*B41J 2/165* (2006.01)
*B41J 2/14* (2006.01)

(52) U.S. Cl. ..... 347/22; 347/23; 347/47

(58) Field of Classification Search ..... 347/22–35, 347/10, 47

See application file for complete search history.

(56) References Cited

U.S. PATENT DOCUMENTS 5,355,158 A 10/1994 Inada et al.
6,378,973 B1 4/2002 Kubota et al.
2002/0041315 A1 4/2002 Kubota et al.
2002/0175972 A1 11/2002 Sanada

FOREIGN PATENT DOCUMENTS

JP 3-193354 A 8/1991
JP 3-293140 A 12/1991
JP 2000-168103 A 6/2000
JP 2002-337363 A 11/2002

*Primary Examiner*—Shih-Wen Hsieh
(74) *Attorney, Agent, or Firm*—Birch, Stewart, Kolasch and Birch, LLP

(57) ABSTRACT

The inkjet head comprises: a nozzle which discharges droplets of ink through an ink discharge port to perform recording onto a recording medium, the ink being supplied through a supply duct, at least partial cross section of the nozzle on a side of the ink discharge port broadening toward the ink discharge port; and a device which moves a position of a boundary surface of the ink between a first boundary surface keeping position inside the nozzle at which the boundary surface of the ink is kept for recording and a second boundary surface keeping position inside the nozzle at which the boundary surface of the ink is kept for cleaning the nozzle under pressure less than or equal to ink discharging pressure, wherein fouling around the nozzle is collected by moving the position of the boundary surface of the ink between the first boundary surface keeping position and the second boundary surface keeping position.

12 Claims, 16 Drawing Sheets

INKJET HEAD AND METHOD OF CLEANING INKJET HEAD

This Non-provisional application claims priority under 35 U.S.C. § 119(a) on Patent Application No(s). 2003-321667 filed in Japan on Sep. 12, 2003, the entire contents of which are hereby incorporated by reference.

BACKGROUND OF THE INVENTION

1. Field of the Invention

The present invention relates to an inkjet head and a method of cleaning the inkjet head, and more particularly to cleaning the inkjet head used in the inkjet recording apparatus so that fouling such as ink adhering around the inkjet head can be removed in a non-contact way without using a blade.

2. Description of the Related Art

An inkjet printer is known such that recording is performed by supplying ink to an inkjet head and discharging the ink in the form of ink droplets from nozzles of the inkjet head toward recording paper. Since an inkjet printer carries out recording by expelling (or discharging) ink from nozzles, a portion of the expelled ink is dispersed in the form of a fine mist. This kind of ink mist, dust from the recording paper (i.e. small shards of paper), or other dirt adheres around the nozzles. If the vicinity of the nozzles becomes soiled to the ink mist, the paper dust, or the other dirt, the flight direction of the ink droplets discharged from the nozzles might change and the achievement of high quality printing might be impossible.

In order to prevent this problem, a head cleaning method in the related art such that the surface of the nozzles is wiped with a blade (or wiper) made from a flexible material such as rubber to remove fouling around the nozzles is commonly used. However, in this method, since the blade slides on and wipes off the nozzle surface, a drawback arises in that it may cause scratches in the nozzle surface or deterioration of the surface processing such as liquid resistance treatment, and stable discharge of the ink over a long period of time might become impossible. Therefore, in place of cleaning method using the blade, various non-contact methods of collecting fouling such as ink around the inkjet head into the interior portion of the nozzles have been proposed.

Japanese Patent Application Publication No. 3-293140 discloses a method of cleaning the peripheral region of a discharge port. According to this patent document, by controlling the energy for discharging ink from the discharge port as ink droplets, column-shaped ink is created, which is not an ink droplet discharged from the discharge port. When ink is refilled into the discharge port, the discharged column-shaped ink spreads about the periphery of the discharge port and combines with the fouling surrounding the discharge port. Then it is suctioned inside the discharge port to collect the fouling.

However, the method disclosed in Japanese Patent Application Publication No. 3-293140 implies a problem in that, since an incomplete pulse or drive waveform resulting in incomplete discharge is supplied in order to create the column-shaped ink for collecting the fouling which is not discharged, the state of the ink droplets is extremely unstable. In some cases, it might be impossible to collect the ink droplets depending on ambient temperature, etc.

Japanese Patent Application Publication No. 3-193354 discloses a method of cleaning the surface of a nozzle. According to this patent document, the viscosity of the ink increases after the nozzle surface of the inkjet head is sealed with a cap preventing the ink in the discharge port from evaporating on standby. If the ink is expelled from the discharge port prior to recording, a portion of the ink might adhere to the nozzle surface. In this case, by controlling the pressure inside the discharge port to become lower than the pressure outside the discharge port, the ink adhered to the nozzle surface is suctioned inside the discharge port to collect the ink.

However, the method described in Japanese Patent Application Publication No. 3-193354 assumes that the adhered ink drops are connected to ink meniscus (i.e. ink boundary) inside the nozzle. This relates to collection of fouling in the case that the ink adheres to the nozzle surface due to capping, but is not applicable to a case that the fouling is separated from the ink meniscus inside the nozzle.

SUMMARY OF THE INVENTION

The present invention considers such circumstances, and its object is to provide an inkjet head and a method of cleaning an inkjet head for efficiently removing fouling which adheres to the vicinity of the nozzles of the head and affects the discharge of ink by a non-contact method without using a blade, etc.

In order to achieve the aforementioned object, a first aspect of the present invention provides an inkjet head comprising: a nozzle which discharges droplets of ink through an ink discharge port to perform recording onto a recording medium, the ink being supplied through a supply duct, at least partial cross section of the nozzle on a side of the ink discharge port broadening toward the ink discharge port; and a device which moves a position of a boundary surface of the ink between a first boundary surface keeping position inside the nozzle at which the boundary surface of the ink is kept for recording and a second boundary surface keeping position inside the nozzle at which the boundary surface of the ink is kept for cleaning the nozzle under pressure less than or equal to ink discharging pressure, wherein fouling around the nozzle is collected by moving the position of the boundary surface of the ink between the first boundary surface keeping position and the second boundary surface keeping position.

According to the first aspect of the present invention, ink or something adhering in the periphery of the nozzle is collected by moving the position of the boundary surface of the ink between one position at which the boundary surface is kept for normal recording and another position at which the boundary surface is kept for cleaning. In other words, the fouling in the vicinity of the nozzle is collected in a non-contact way i.e. without using a blade. Therefore, the nozzle surface can be cleaned more efficiently without causing damage to the nozzle surface and the time required to operate the blade can be saved. Furthermore, by setting the two keeping positions of the boundary surface inside the nozzle for normal recording and for cleaning, the boundary surface of the ink can be reliably restored after the keeping position of the boundary surface of the ink is moved. Moreover, the cross section inside the nozzle on the side of the ink outlet is formed so as to broaden toward the outlet (e.g. the cross section inside the nozzle is formed in a tapered shape or an incline). If ink droplets adhere inside the nozzle, they have little effect on the flight direction of the discharged ink as long as they are situated at a distant position from the position of the boundary surface of the ink for recording.

The inner wall of the nozzle of the inkjet head according to the first aspect of the present invention is preferably formed so as to have three contact angles with respect to the ink, the contact angles gradually increasing from ink supply side to ink discharge side. Moreover, a step or a groove is preferably formed in a portion of the inner wall of the nozzle, the cross section of the portion being formed so as to broaden toward the ink discharge port. Thus, it is possible to stabilize the aforementioned two boundary surface keeping positions when the position of the boundary surface of the ink moves.

The inkjet head according to the first aspect of the present invention preferably comprises a device for moving the position of the boundary surface of the ink moves the position of the boundary surface of the ink by controlling the pressure applied to the ink. Therefore, it is possible to do fine adjustment to the position of the boundary surface and to do rapid adjustment to the movement of the position of the boundary surface by controlling the pressure applied to the ink.

The inkjet head according the first aspect of the present invention preferably comprises a discharging actuator for actuating the nozzle to discharge the droplets of the ink wherein the position of the boundary surface of the ink inside the nozzle is moved for each nozzle or each block of nozzles by using the discharging actuator as the device for moving the position of the boundary surface of the ink. Since ink droplets inside the nozzle are collected independently in each nozzle or in each block, it is possible to collect the ink droplets adhering to the peripheral region of the nozzle which is not discharging ink even while recording image.

The inkjet head according to the first aspect of the present invention preferably comprises a preliminary ink discharging mechanism wherein preliminary discharging of the ink is implemented after the fouling around the nozzle is collected by moving the position of the boundary surface of the ink. Thus, it is possible to prevent impurities or ink droplets with increased viscosity from dispersing inside the pressure chamber of the inkjet head. The preliminary discharge of the ink is preferably implemented according to the dirtiness of the nozzle, the printing time recorded by a timer, or dirt detected by a sensor. In this way, the consumption of the ink can be reduced.

Similarly, in order to achieve the aforementioned object, a second aspect of the present invention is a method of cleaning an inkjet head for removing fouling around a nozzle of the inkjet head discharging onto a recording medium droplets of ink supplied through a supply duct to perform recording, comprising: forming the nozzle such that at least a partial cross section of the nozzle on a side of an ink discharge port broadens toward the ink discharge port; and collecting fouling around the nozzle by moving a position of a boundary surface of the ink between a first boundary surface keeping position inside the nozzle at which the boundary surface of the ink is kept for recording and a second boundary surface keeping position inside the nozzle at which the boundary surface of the ink is kept for cleaning the nozzle under pressure less than or equal to ink discharging pressure.

The inner wall of the nozzle according to the second aspect of the present invention is preferably formed so as to have three contact angles with respect to the ink, the contact angles gradually increasing from ink supply side to ink discharge side. Moreover, a step or a groove is preferably formed in a portion of the inner wall of the nozzle, the cross section of the portion being formed so as to broaden toward the ink discharge port.

The position of the boundary surface of the ink according to the second aspect of the present invention is preferably moved by controlling the internal pressure of the ink. Furthermore, the position of the boundary surface of the ink inside the nozzle is preferably moved for each nozzle or each block of nozzles by using a discharging actuator for actuating the nozzle to discharge the droplets of the ink.

The method according to the second aspect of the present invention preferably comprises the step of implementing preliminary discharging of the ink after the fouling around the nozzle is collected by moving the position of the boundary surface of the ink. Moreover, the preliminary discharge of the ink is preferably implemented according to the dirtiness of the nozzle.

According to the method, it is possible to achieve beneficial effects similar to the inkjet head according to the first aspect of the present invention.

According to the inkjet head and the method of cleaning the inkjet head of the present invention as described above, it is possible efficiently to remove fouling in the vicinity of the nozzles of the inkjet head in a non-contact way without using a blade. Furthermore, since the two keeping positions for the boundary surface of the ink inside the nozzles are provided at which the boundary surface is kept for normal recording and for cleaning, the position of the boundary surface can be reliably restored after the position of the boundary surface is moved. In addition, the cross section of the nozzle on the side of the discharge port broadens toward the outlet side. Therefore, even if an ink droplet adheres to the upper portion of this broadened section, it does not affect the flight direction of subsequently discharging ink droplets.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 4A shows the state of the ink for normal recording; and FIG. 4B shows the state of the ink for nozzle cleaning;

FIG. 5A shows the state of the ink for normal recording; FIG. 5B shows a state in which the boundary surface of the ink is the same as the state for normal recording and the pressure applied to the ink is slightly raised; and FIG. 5C shows the state of the boundary surface of the ink for nozzle cleaning;

FIG. 7A shows the state of ink for normal recording; FIG. 7B shows the state of ink for nozzle cleaning, and FIG. 7C shows the state of the ink after fouling has been collected;

DETAILED DESCRIPTION OF THE PREFERRED EMBODIMENTS

Figure 1:
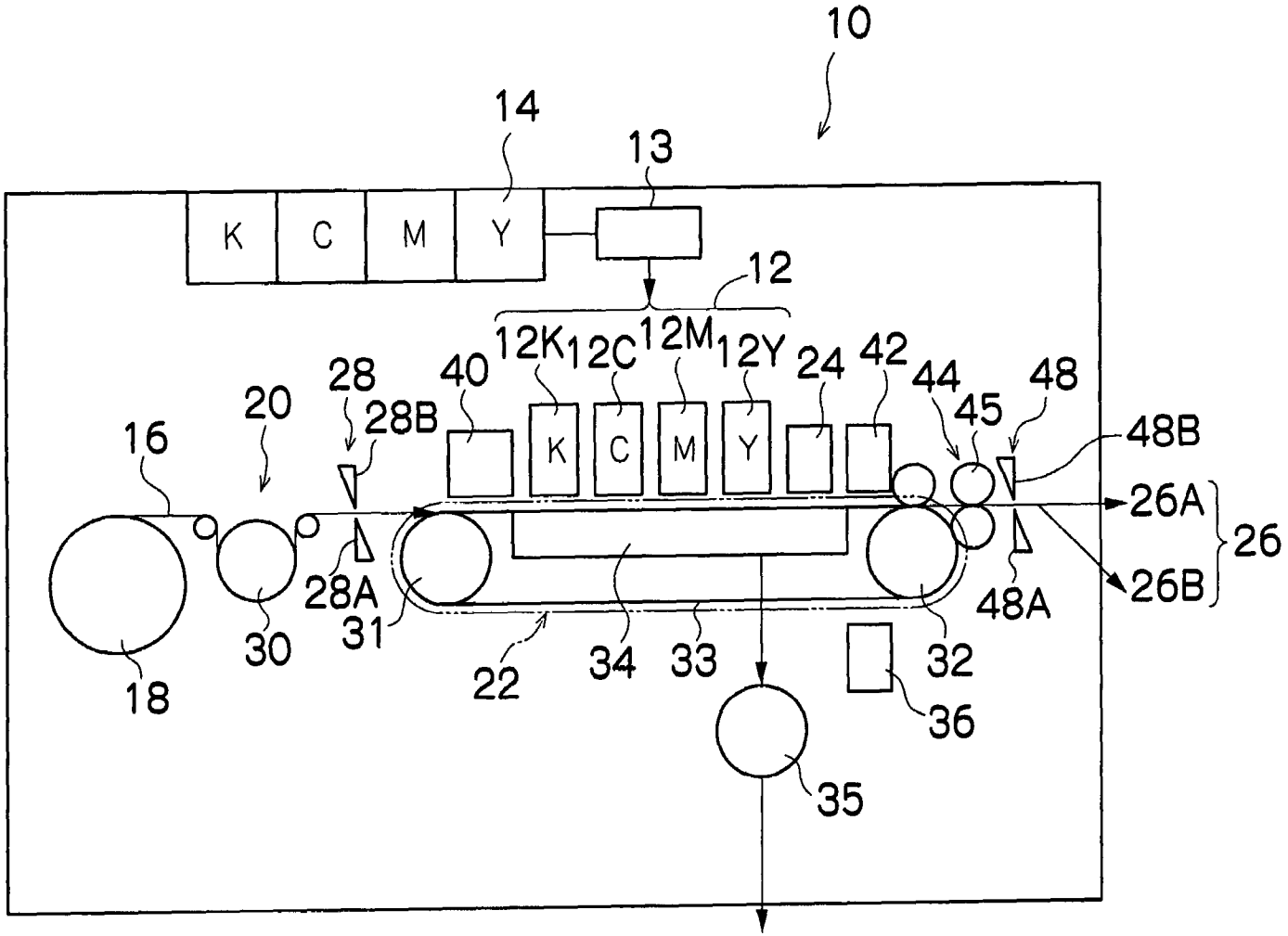
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-roplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. The belt 33 is driven in the clockwise direction in FIG. 1 by the motive force of a motor (not shown in FIG. 1, but shown as a motor 88 in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction), which is substantially perpendicular to a width direction of the recording paper 16. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

Further, a boundary surface control device 13 for moving the boundary surface of the ink in the nozzle interior of the head is provided on a supply path along which ink is supplied from the ink storing/loading unit 14 to the print unit 12. The actions of the boundary surface control device 13 will be described in detail below, but there are no particular limitations on the specific structure of the boundary surface control device 13 as long as it is able to move the ink boundary surface in the interior of the nozzle between predetermined positions. For example, the boundary surface control device 13 may be composed of a pump, a valve, a pressure gauge, and the like to control the internal pressure in the head.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements, which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, a sorter for collecting prints according to print orders is provided to the paper output unit 26A for the target prints.

Next, the inkjet head is described. The respective inkjet heads 12K, 12C, 12M and 12Y provided for each color of ink have a common structure. Hereinafter the inkjet head is indicated below with the numeral 50 as a representative example of these inkjet heads 12K, 12C, 12M, and 12Y.

Figure 2:
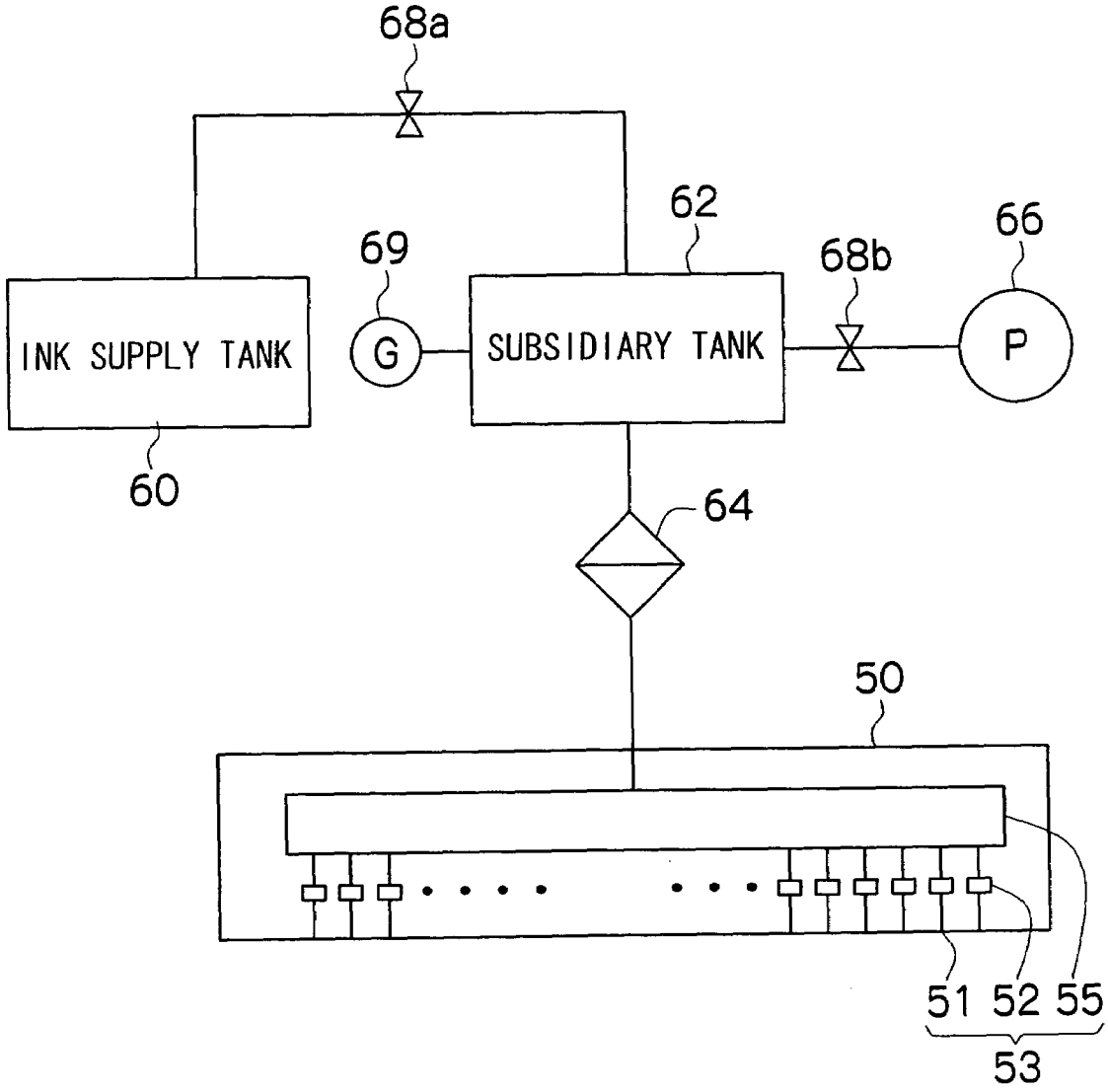
FIG. 2 is a schematic diagram showing the composition of an inkjet head.

FIG. 2 is a schematic diagram showing the composition of an inkjet head. As shown in FIG. 2, the inkjet head 50 has a structure comprising a plurality of aligned ink chamber units 53 respectively constituted by a plurality of nozzles 51 which discharge ink, a pressure chamber 52 corresponding to each of the respective nozzles 51, and a common flow passage 55 for supplying ink to the respective pressure chambers 52. In order to achieve high-quality printing and recording, it is necessary to set the dot pitch at which ink is printed onto the recording paper to a very high density. For example, the density of the nozzle pitch can be increased by providing a large number of ink chamber units 53 which are disposed like a hounds tooth check on a plane.

The ink supplied to the inkjet head 50 is stored in an ink supply tank 60. The ink supply tank 60 is the base tank for supplying ink, and is it disposed in the ink storing and loading unit 14. The ink in the ink supply tank 60 is stored temporarily in a subsidiary tank 62. The ink in the subsidiary tank 62 is supplied to the common flow passage 55 of the inkjet head 50, via a filter 64 which serves to remove foreign material and bubbles. The pressure applied to the supply ink is controlled by means of a pump 66. Furthermore, a valve 68*a* and a valve 68*b* are provided respectively between the ink supply tank 60 and the subsidiary tank 62, and between the pump 66 and the subsidiary tank 62. A pressure gauge 69 for measuring the internal pressure of the ink is provided in the subsidiary tank 62.

Figure 3:
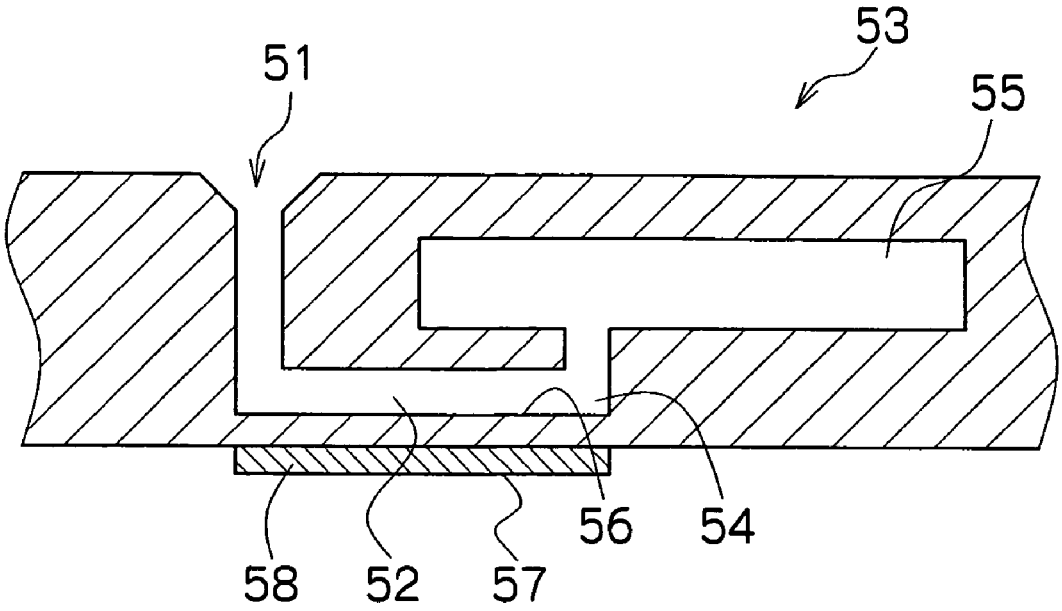
FIG. 3 is a cross-sectional diagram showing a two-dimensional composition of an ink chamber unit.

FIG. 3 is a cross-sectional diagram showing a two-dimensional composition of an ink chamber unit 53. In FIG. 3, the ink discharge port of the nozzle 51 is shown as facing upwards. The pressure chamber 52 provided with respect to the nozzle 51 from which an ink droplet is discharged has an approximately square shape in plan view, when observed from above, and the nozzle 51 and the supply opening 54 are disposed in respective corner sections on the line of symmetry of this square shape. Furthermore, the pressure chamber 52 is connected via the supply opening 54 to the common flow passage 55.

An actuator 58 provided with an individual electrode 57 is joined to a pressure plate 56 which forms the lower face of the pressure chamber 52, and the actuator 58 is deformed when a drive voltage is supplied to the individual electrode 57, thereby causing ink to be discharged from the nozzle 51. When ink is discharged, new ink is supplied to the pressure chamber 52, from the common flow path 55, via the supply opening 54.

According to the present invention, the structure of the ink chamber unit is not limited to that of the example illustrated. For example, in the illustrated example, a method is employed where an ink droplet is ejected by means of the deformation of the actuator 58, which is typically a piezoelectric element, but in implementing the present invention, the method used for discharging ink is not particularly limited; Instead of a piezo jet method, it is also possible to apply various types of methods, such as a thermal jet method where the ink is heated and bubbles are caused to form therein by means of a heat generating body such as a heater, ink droplets being ejected by means of the pressure of these bubbles.

Figure 4A:
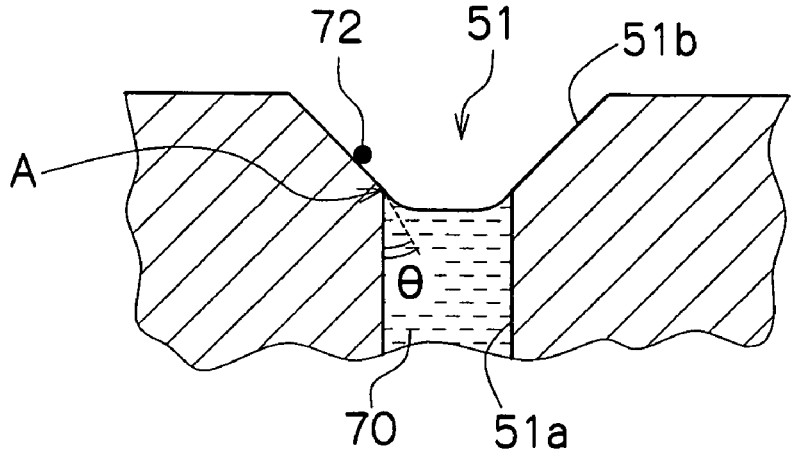
FIGS. 4A and 4B are cross-sectional views showing a nozzle section of an ink chamber unit.
Figure 4B:
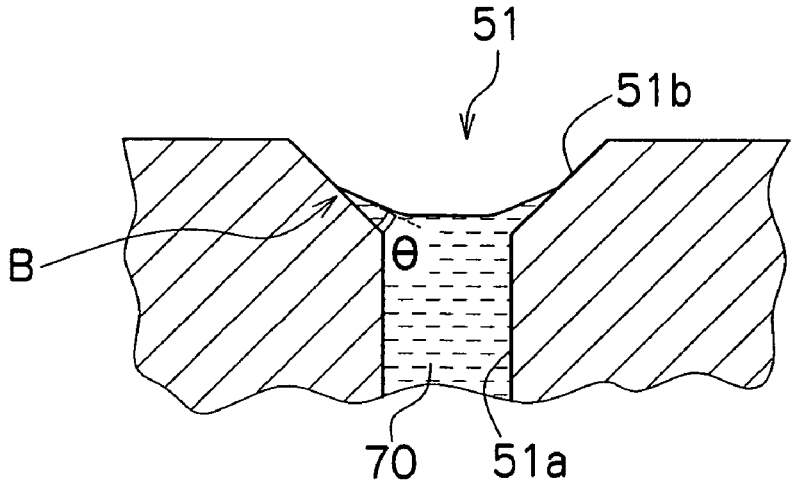

FIGS. 4A and 4B show an enlarged view of the region of the nozzle 51 in the ink chamber unit 53. FIG. 4A shows the state of the ink for normal recording, and FIG. 4B shows the state ink for nozzle cleaning. As shown in FIG. 4A, the ink passage of the nozzle 51 is formed in a linear tubular shape of uniform cross-section on the ink supply side (lower side in the diagram) and it is formed in a tapered shape where the cross-section broadens toward the outlet, on the ink discharge port side (upper side in the diagram).

Furthermore, in the example shown in FIGS. 4A and 4B, the inner wall faces of the nozzle 51 are formed in such a manner that they are liquid-attracting, both on the ink supply side 51*a* and on the ink discharge port side 51*b*. In FIG. 4A, the ink 70 is supplied (controlled) in such a manner that the boundary surface thereof is positioned at a first boundary surface keeping position (hereinafter called the "first clip point") inside the nozzle, which is the position maintained by the boundary surface of the ink for normal recording, and is situated in the boundary region between the linear tube-shaped ink supply side 51 a of the nozzle 51 and the ink discharge port side 51*b* thereof. Furthermore, in this case, fouling 72, such as ink, adheres at an intermediate position of the tapered ink discharge port side 51*b*.

In FIG. 4B, the ink 70 is supplied (controlled) in such a manner that the boundary surface thereof is positioned at a second boundary surface keeping position (hereinafter, called "second clip point") inside the nozzle, which is the position maintained by the boundary surface of the ink for nozzle cleaning, and is situated at an intermediate position of the tapered ink discharge port side 51*b* of the nozzle 51. Furthermore, since all of the inner walls of the nozzle 51 are liquid-attracting, the angle θ at which the boundary surface of the ink makes contact with the inner wall of the nozzle 51 is always a small, acute angle, at both of the clip points (boundary surface keeping positions) A and B, illustrated in FIGS. 4A and 4B. In other words, the meniscus (i.e. boundary surface) of the ink 70 is formed with a downwardly recessed shape, as illustrated in the drawings.

Next, a method for cleaning the inkjet head according to the present invention will be described. As shown in FIG. 4A, for normal recording, the position of the boundary surface of the ink is controlled such that it is situated at the first clip point A. It is supposed that, in this case, fouling 72 such as ink generated by the discharge of ink is adhering to an intermediate position of the ink discharge port side 51*b* of the inner wall surface of the nozzle 51. Here, a cleaning operation is performed and the fouling 72 is removed.

As shown in FIG. 4B, the position of the boundary surface of the ink 70 is caused to move to the second clip point B under a pressure that is equal to or lower than the discharging pressure, in such a manner that the fouling 72 is absorbed into the ink 70. Thereupon, the position of the boundary surface of the ink is moved again until the first clip point A, as illustrated in FIG. 4A. Thereby, the ink 70 moves downwards in the diagram while containing the fouling 72, and hence the fouling 72 can be collected.

In this way, in the present embodiment, the position of the boundary surface of the ink in the nozzle 51 spreads outward beyond the first clip point A, which is the boundary surface keeping position inside the nozzle for normal recording (or discharging), moves to the second clip point B, and then retreats. Therefore, fouling 72 such as ink mist, which is adhering to the tapered ink discharge port side 51*b* of the nozzle 51 in such a manner that it is not connected directly to the boundary surface of the ink during discharge, is collected into the nozzle 51.

The movement of the position of the boundary surface of the ink can be achieved by controlling the pressure applied to the ink 70, or by driving the actuator 58 used for discharge under pressure equal to or less than the discharge pressure. In general, controlling the pressure applied to the ink is the more desirable method, since it allows a large displacement of the position of the boundary surface of the ink.

The nozzle cleaning operation by means of moving the position of the boundary surface of the ink upwards and downwards may be carried out in each nozzle individually, or it may be carried out respectively for each block constituted by a plurality of nozzles. If cleaning is carried out individually for each nozzle, then this can be achieved by driving the respective actuators disposed in each of the respective nozzles. Hereafter a concrete method for controlling the pressure applied to the ink for each respective block is described in detail.

It can also be devised that the upward and downward movement of the boundary surface of the ink in order to eliminate fouling in the periphery of the nozzle also serves to provide the movement (slight oscillation) of the meniscus in order to prevent the ink on the surface of the nozzle from drying out. By so doing, a special structure for upward and downward movement of the meniscus in order to recover ink (for example, a negative pressure control device inside the head) is not particularly necessary. Hence there is no additional composition of complicated device.

Figure 5A:
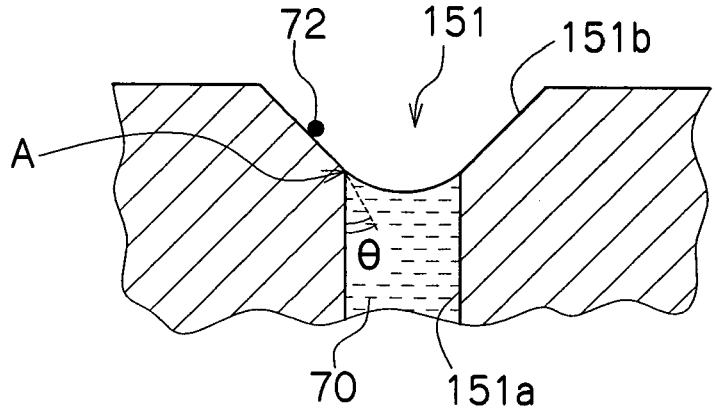
FIGS. 5A, 5B and 5C are cross-sectional diagrams showing a further example of the nozzle.
Figure 5B:
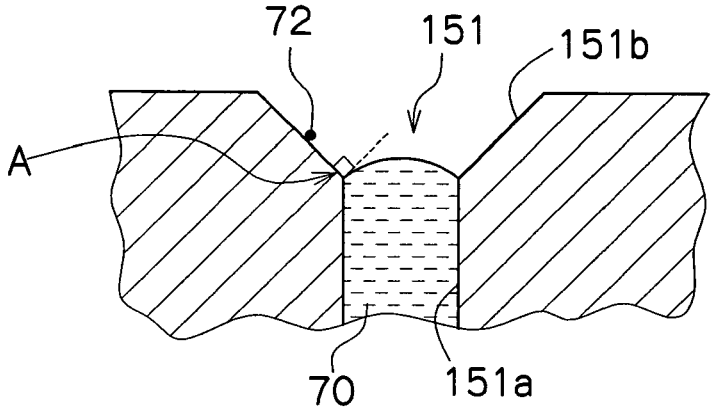
Figure 5C:
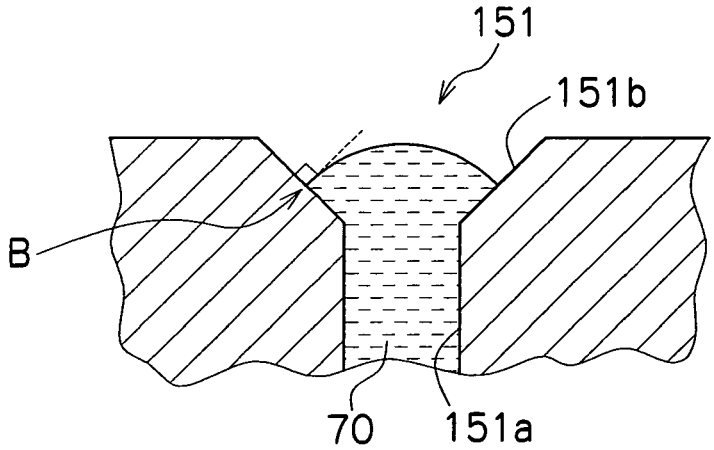

Next, another example of a nozzle will be described. FIGS. 5A, 5B and 5C show another example of a nozzle. FIG. 5A shows the state of the ink during normal recording, FIG. 5B shows a state where the pressure applied to the ink has been raised slightly, whilst the position of the boundary surface of the ink is the same as that during normal recording; and FIG. 5C is shows a state of the ink during nozzle cleaning.

As shown in FIG. 5A, the shape of the nozzle 151 according to this example is the same as the nozzle 51 shown in FIGS. 4A and 4B, the ink supply side 151*a* situated below the nozzle inner wall having a linear tubular shape of uniform cross-sectional shape, and the ink discharge port side 151*b* situated above the nozzle inner wall being formed with a tapered cross-section which expands toward the outlet.

This nozzle 151 differs from the nozzle 51 described above in respect of the state of the inner walls of the nozzle, in that whereas the ink supply side 151*a* is liquid-attracting, the ink discharge port side is subjected to liquid-repelling treatment in such a manner that the inner walls are liquid-repelling. More specifically, as shown in FIG. 5A, in the case of normal recording, the position of the boundary surface of the ink is the first clip point, as illustrated by symbol A in the diagram, and since the ink supply side 151*a* of the inner wall of the nozzle is liquid-attracting, the angle θ at which the boundary surface of the ink 70 makes contact with the inner wall of the nozzle is an acute angle, and the meniscus of the ink 70 forms a downward, recessed shape. Moreover, it is supposed that fouling 72 such as ink mist adheres to an intermediate position of the ink discharge port side 151*b*.

In this case, as shown in FIG. 5B, while keeping the position of the boundary surface of the ink at the first clip point A, the pressure of the ink 70 is increased slightly and the meniscus of the ink 70 is caused to protrude in the upward direction. As shown in FIG. 5B, the angle at which the boundary surface of the ink 70 in this case makes contact with the inner wall of the nozzle is approximately 90°. However, the ink 70 and the fouling 72 are not yet connected, and the ink 70 is not able to adsorb the fouling 72.

Therefore, as shown in FIG. 5C, the pressure applied to the ink 70 is further increased, and the position of the boundary surface of the ink is caused to rise, until it reaches the second clip point indicated by the symbol B in the drawing. Thereby, the ink 70 absorbs the fouling 72, and the position of the boundary surface of the ink 70 is then lowered, so that the fouling 72 can be collected inside the nozzle.

In this example, since the taper-shaped ink discharge port side 151*b* of the inner wall of the nozzle 151 is formed so as to be liquid-repelling, the meniscus of the ink 70 protrudes upwards, and therefore the position of the boundary surface of the ink is stably kept or clipped. Furthermore, since the boundary surface is bulging upwards, the fouling 72 on the inclined surface can be absorbed readily.

Figure 6:
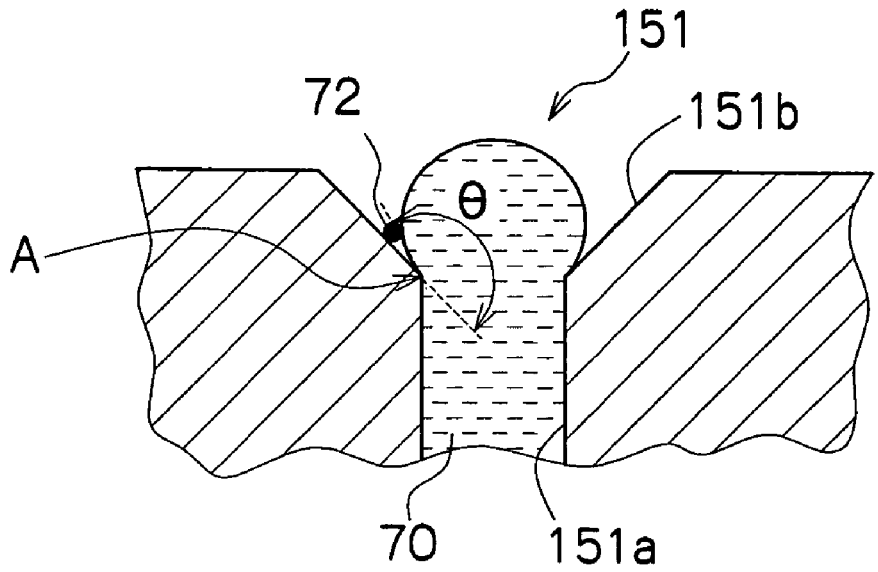
FIG. 6 is a cross-sectional view showing another example of a nozzle in which the liquid-repelling properties on the discharge port side of the nozzle increases.

Furthermore, when the liquid-repelling property of the ink discharge port side 151*b* of the inner wall of the nozzle 151 further increases and the angle of contact further increases to increase the angle θ at which the boundary surface of the ink 70 makes contact with the inner wall of the nozzle, the meniscus of the ink 70 further protrudes upward and shows even greater change in shape as shown in FIG. 6. Therefore, the fouling 72 on the inclined surface can be absorbed easily.

More specifically, as shown in FIG. 6, when the pressure of the ink 70 is increased while the position of the boundary surface of the ink 70 is kept at the first clip point A, the meniscus of the ink 70 is caused to swell upwards significantly, and the angle at which the boundary surface of the ink 70 makes contact with the inner wall of the nozzle 0 becomes a large, obtuse angle. Therefore the ink 70 makes contact with the fouling 72. When the ink 70 and the fouling 72 have connected, the pressure of the ink 70 is reduced, and the meniscus of the ink 70, which contains the fouling 72 therein, is returned to its original position, whereby the fouling 72 can be collected. In this case, the clip point may be only one clip point, namely, the first clip point A.

In this way, if the liquid-repelling treatment of the tapered ink discharge port side 151*b*, and hence the angle θ of contact between the boundary surface of the ink and the inner wall of the nozzle, is increased (for example θ=100° and desirably approximately 120°), then it is possible to remove the fouling, simply by changing the meniscus of the ink, but without changing the clip point, namely, the position at which the boundary surface of the ink is held.

Figure 7A:
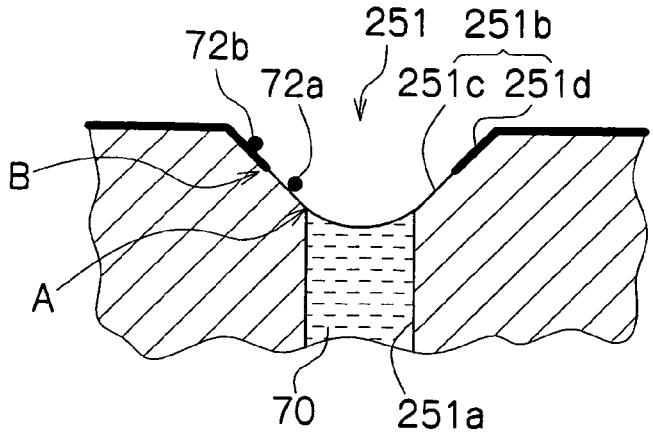
FIGS. 7A, 7B and 7C are cross-sectional view showing another example of the nozzle.
Figure 7B:
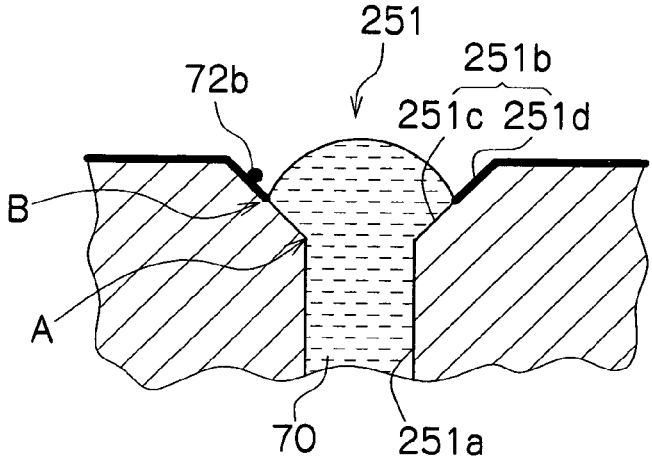
Figure 7C:
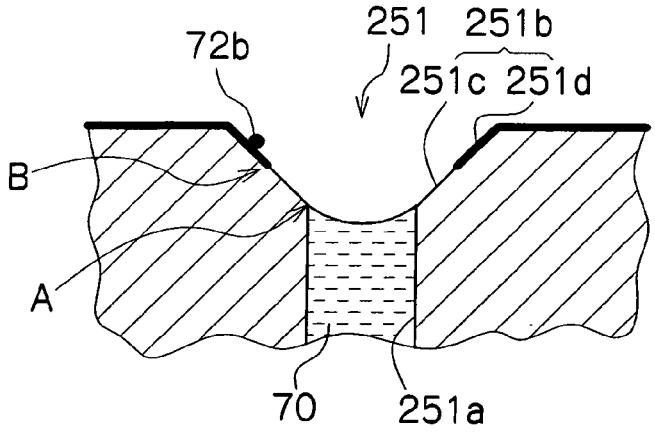

Next, another example of a nozzle will be described. FIGS. 7A, 7B and 7C show a cross-section of another example of a nozzle. FIG. 7A shows the state of ink during normal recording, FIG. 7B shows the state of ink during nozzle cleaning, and FIG. 7C shows the state of the ink after fouling has been collected.

In FIG. 7A, the shape of the nozzle 251 is the same as that shown in FIG. 4A or 5A. More specifically, the ink supply side 251*a* of the inner wall of the nozzle 251 is formed in a linear tubular shape having a uniform cross-section, and the ink discharge port side 251*b* is formed like a taper which expands in the upward direction. In the nozzle 251 in this example, the ink supply side 251*a* is liquid-attracting, but the tapered, angled faces (ink discharge side 251*b*) are liquid-repelling, and furthermore, the upper portion 251*d* is subjected to liquid-repelling treatment which produces an increase in the angle of contact of the ink, to a greater extent than the lower portion 251*c* thereof, and hence it has greater liquid-repelling properties. In order to raise the liquid-repelling properties of the upper portion 251*d* above those of the lower portion 251*c*, it is possible to change the base layer underneath the inner wall of the nozzle 251, or it is possible to change the surface treatment, while maintaining the same base layer.

In this way, the inner wall of the nozzle 251 is formed so as to be ink-attracting on the ink supply side 251*a*, ink -repelling in the lower portion 251*c* of the ink discharge port side 251*b*, and strongly liquid-repelling in the upper portion 251*d* thereof, and hence the size of the angle of contact θ between the ink and the respective surfaces becomes successively larger in three stages, where the ink supply side 251*a*<the lower portion 251*c* of the ink discharge port side 251*b* <the upper portion 251*d* of the ink discharge port side

251*b*. By dividing the ink discharge port side 251*b* into two portions in this way, and altering the liquid-repelling properties between the upper portion 251*d* and the lower portion 251*c*, a second clip point B is established at the boundary region thereof, and hence the boundary surface of the ink 70 can be held reliably at this point.

Hereafter, the head cleaning method according to this example is described. Firstly, in FIG. 7A, the ink 70 is located in the section of the ink supply side 251*a* on the inner wall of the nozzle 251, and the boundary surface is held at the first clip point A. Moreover, it is supposed that two adhering matters 72*a*, 72*b* are adhering to the ink discharge port side 251*b*, which is a tapered and inclined surface. Here, the fouling 72*a* on the lower side of the inclined surface has a bearing on the discharge of the ink 70, but the fouling 72*b* which is situated in a distant position from the ink 70 does not affect the discharge of the ink 70 or the ink droplets that are discharged. Consequently, it is necessary to remove the fouling 72*a*, but it is unnecessary to remove the fouling 72*b*.

Next, as shown in FIG. 7B, the pressure applied to the ink 70 is increased within a range that does not cause the ink 70 to be discharged, and the boundary surface of the ink 70 is caused to rise to the second clip point B. Since the ink discharge port side 251*b* of the inner wall of the nozzle 251 has liquid-repelling properties, then the meniscus of the ink 70 adopts an upwardly protruding shape, as shown in the diagram. Thereby, the fouling 72*a* on the lower portion 251*c* of the inclined surface connects with the ink 70, and is absorbed. Furthermore, since, in this case, the upper portion 251*d* has enhanced liquid-repelling properties, then even if there is fluctuation in the pressure applied to the ink 70 when the boundary surface of the ink 70 is raised or lowered within a range which does not cause discharge of the ink 70, the high liquid-repelling properties will mean that the ink 70 does not leak out from the nozzle 251.

Next, as shown in FIG. 7C, the pressure applied to the ink 70 is lowered, and the boundary surface of the ink 70 descends to the first clip point A. Thereby, the fouling 72*a* that has adhered to the lower portion 251*c* of the inclined surface is absorbed inside the nozzle 251. In this way, it is supposed that cleaning of fouling on the nozzle 251 is carried out up to the lower side portion 251*c* of the inclined surface. In this case, since the outlet side of the inner wall of the nozzle 251 is formed as an inclined surface, the fouling 72*b* situated on the upper portion of the inclined surface does not affect the discharge of ink 70. Therefore, there is no particular requirement to remove it as described above.

Figure 8:
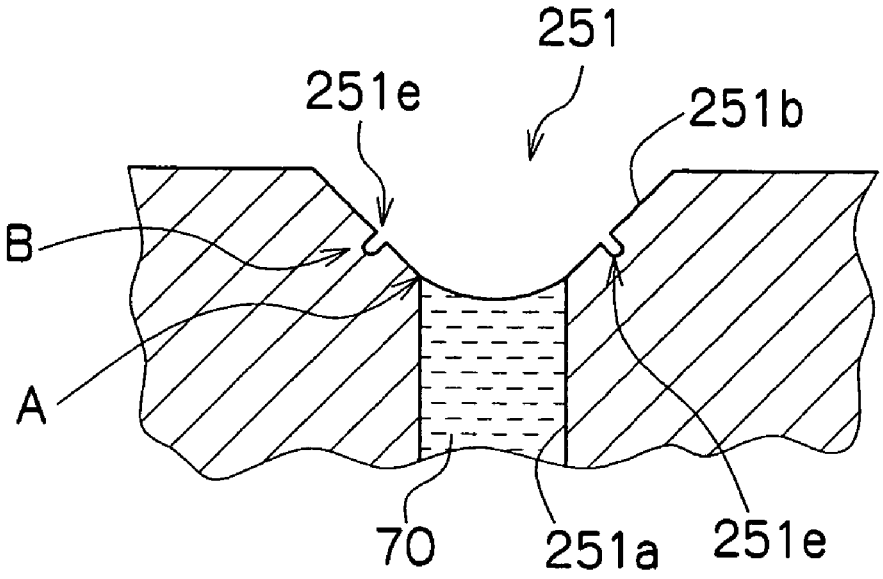
FIG. 8 is cross-sectional view showing another example having a groove in the inclined surface of the nozzle.

Moreover, although the liquid-repelling properties are changed in two steps, in such a manner that the angle of contact of the ink with respect to the ink discharge port side 251*b* of the inner wall of the nozzle 251 changes, instead of this, it is also possible to provide a groove 251*e* in the position at which a second clip point B is to be situated, in an intermediate position of the ink discharge port side 251*b*, as illustrated in FIG. 8. This groove 251*e* is provided following the inner wall of the nozzle 251, and has the effect of keeping the boundary surface of the ink 70, reliably, at that position, when the boundary surface is raised.

Figure 9A:
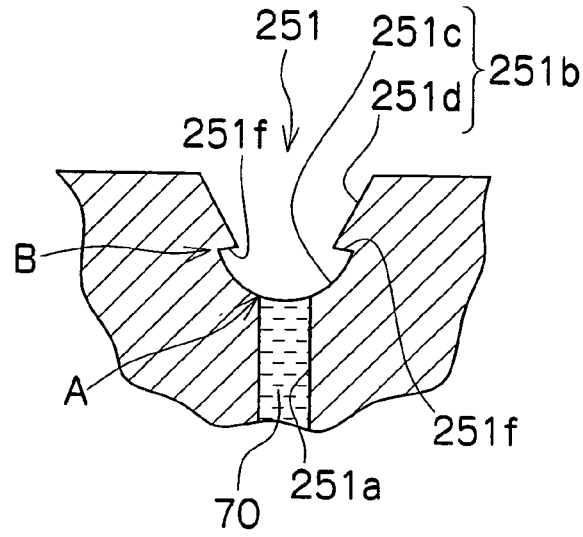
FIGS. 9A, 9B and 9C are sectional views illustrating examples in which the nozzle has a step on its incline.
Figure 9B:
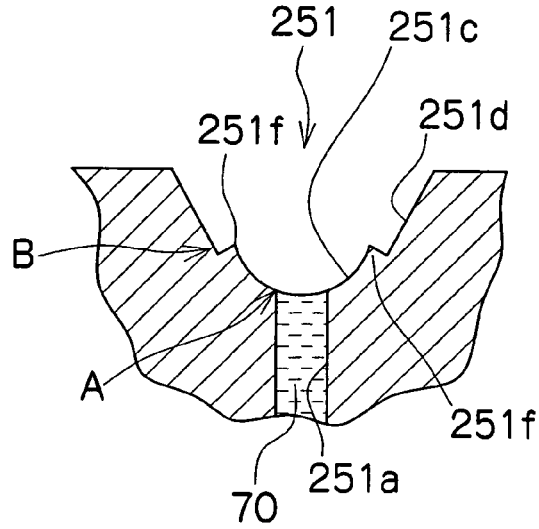
Figure 9C:
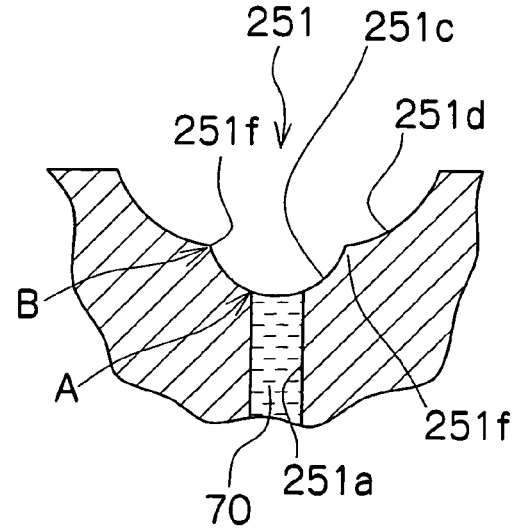

Further, as shown in FIGS. 9A to 9C, a step 251*f* may be provided instead of the groove 251*e* in the position at which the second clip point B is to be situated on the ink discharge port side 251*b* of the inner wall surface of the nozzle 251.

For example, as shown in FIG. 9A, the step 251*f* may be provided in the second clip point B on the ink discharge port side 251*b* such that the upper portion 251*d* protrudes further upward than the lower side portion 251*c*. In so doing, the boundary surface of the ink 70 can be stopped reliably at the position of the step 251*f* when the boundary surface of the ink 70 is moved.

Alternatively, as shown in FIG. 9B, the step 251*f* may be formed such that the lower portion 251*c* of the second clip point B protrudes further upward than the upper portion 251*d*. In this case, there are no particular limitations on the method by which the step 251*f* is formed, and as shown in FIG. 9C, the step 251*f* may be formed by altering the sectional radius of curvature of the ink discharge port side 251*b* of the nozzle 251 at the lower portion 251*c* and upper portion 251*d* of the second clip point B.

As described above, several examples of nozzles are used to describe a method where fouling situated on an inclined surface on the outlet side of the inner wall of a nozzle is collected by moving the boundary surface of the ink upwards and downwards, but desirably, after the fouling has been collected, the ink containing the fouling is preliminarily discharged (or purged) to a purge receptacle, in such a manner that the fouling is removed. It is also possible to ensure that the ink containing fouling is discharged (purged) in a black image position for recording. This is because, in a black part of the image, even if foreign material is present, it does not stand out strongly. Moreover, if ink containing fouling is discharged (or purged), then there is a possibility that the discharge might not proceed normally and that the liquid droplet might break up, but even in such cases, provided that a black image is being recorded, this can have relatively little effect on the image.

Hereafter, a method is described where the upward and downward movement of the boundary surface of the ink is achieved by controlling the pressure applied to the ink.

If, for example, all of the nozzles 51 are connected to a single common flow passage 55, as illustrated in FIG. 2, then the boundary surface of the ink inside all of the nozzles 51 is moved by controlling the pressure applied to the ink, by means of a pump 66. Moreover, if the pressure applied to the ink is controlled with respect to each of the nozzles 51, independently, then this should be carried out by using the discharge actuators 58 disposed respectively at each of the nozzles 51. As shown below, a method is described where the pressure applied to the ink is controlled with respect to respective blocks, each constituted by a plurality of nozzles 51.

Figure 10:
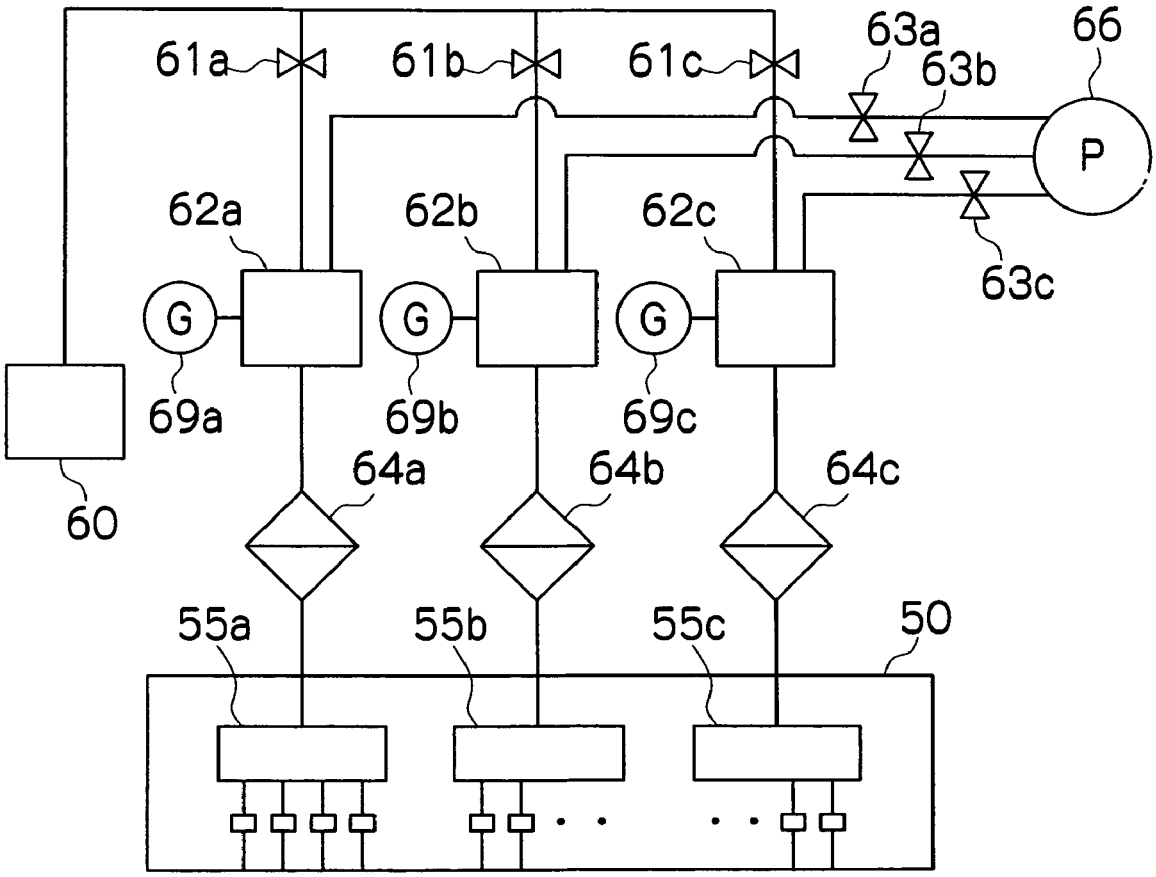
FIG. 10 is a conceptual diagram showing an example where the movement of the boundary surface of the ink is implemented by controlling the pressure of the ink.

Firstly, the example illustrated in FIG. 10 shows a case where the nozzles in an inkjet head 50 are divided into three blocks, which are constituted in such a manner that they receive a supply of ink via independent subsidiary tanks 62*a*, 62*b*, and 62*c*, independent filters 64*a*, 64*b*, 64*c*, and independent common passages 55*a*, 55*b*, and 55*c*. Furthermore, in this case, there is one supply base ink tank 60, valves being provided respectively between the three subsidiary tanks 62*a*, 62*b*, and 62*c* and the ink tank 60, and the three subsidiary tanks 62*a*, 62*b*, and 62*c* control the pressure applied to the ink by means of a single common pump 66, and the valves 63*a*, 63*b*, and 63*c*. Here, pressure gauges 69*a*, 69*b*, 69*c* for measuring the internal ink pressure are provided in the subsidiary tanks 62*a*, 62*b*, 62*c*, respectively. For example, it is possible to control the pressure in the subsidiary tank 62*a* only, of the subsidiary tanks 62*a*, 62*b*, and 62*c*, by operation of the pump 66, by opening only the valve 63*a* of the valves 63*a*, 63*b* and 63*c* of the pump 66 (the valves 63*b* and 63*c* being closed), and closing only the valve 61*a* of the valves 61*a*, 61*b*, and 61*c* between the ink tank 60 and the subsidiary tanks 62*a*, 62*b*, and 62*c* (the valves 61*b* and 61*c* being opened).

By means of the composition of this kind, it is possible to control the pressure applied to the ink, independently and respectively, in the three nozzle blocks, and hence a head cleaning operation can be carried out independently in each block. Thereby, even while recording, it is possible to carry out cleaning of a block that is not being used.

Figure 11:
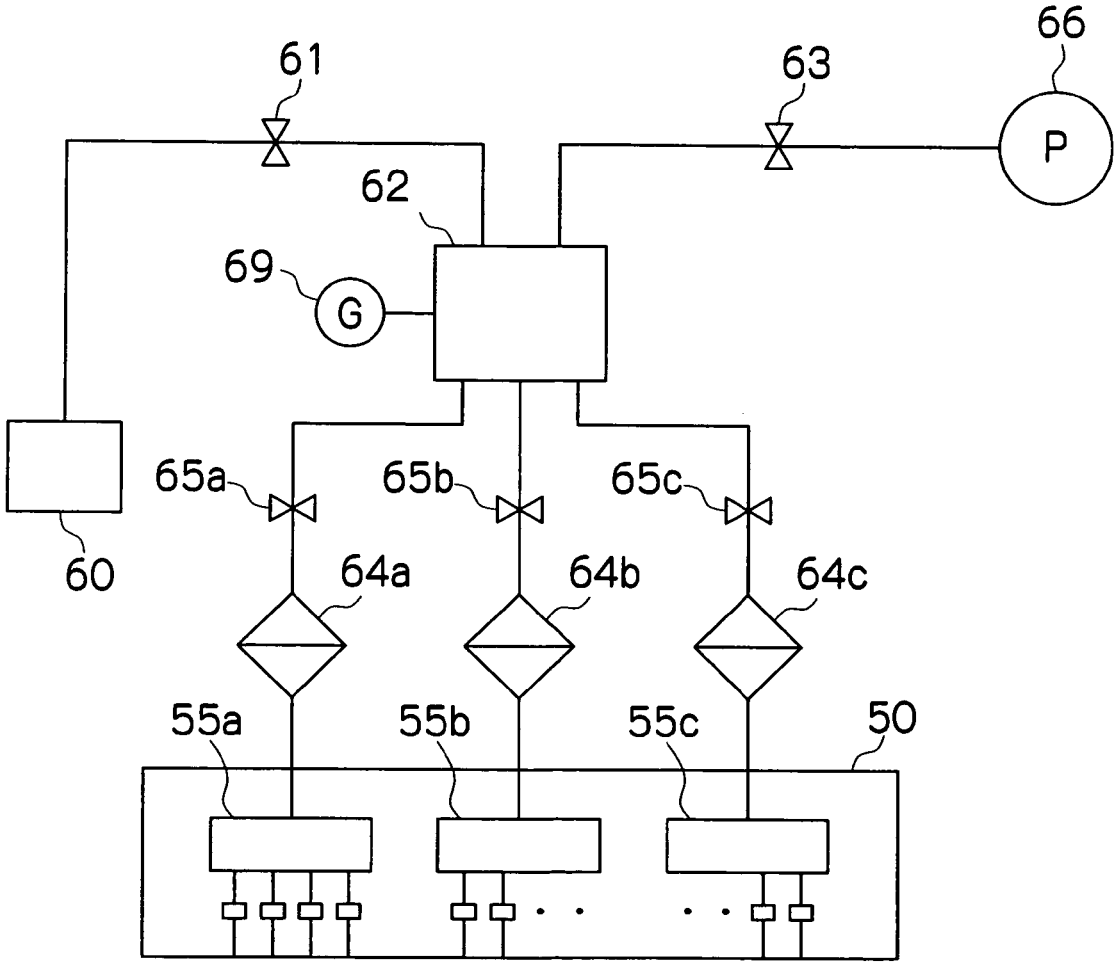
FIG. 11 is a conceptual diagram similarly showing an example where the movement of the boundary surface of the ink is implemented by controlling the pressure of the ink.

Furthermore, in the example of FIG. 10, subsidiary tanks 62*a*, 62*b* and 62*c* are prepared, respectively for three blocks, but as shown in FIG. 11, it is also possible to prepare one subsidiary tank 62 for the three blocks. In this case, a valve 61 is provided between the ink tank 60 and the subsidiary tank 62, and a valve 63 is provided between the subsidiary tank 62 and the pump 66, and valves 65*a*, 65*b*, and 65*c* are provided respectively between the subsidiary tank 62 and the respective filters 64*a*, 64*b* and 64*c*. Further, the pressure gauge 69 is provided in the subsidiary tank 62. By means of a composition of this kind, it is possible to reduce the number of valves, and by sharing the use of the subsidiary tank, the device can be made more compact.

Figure 12:
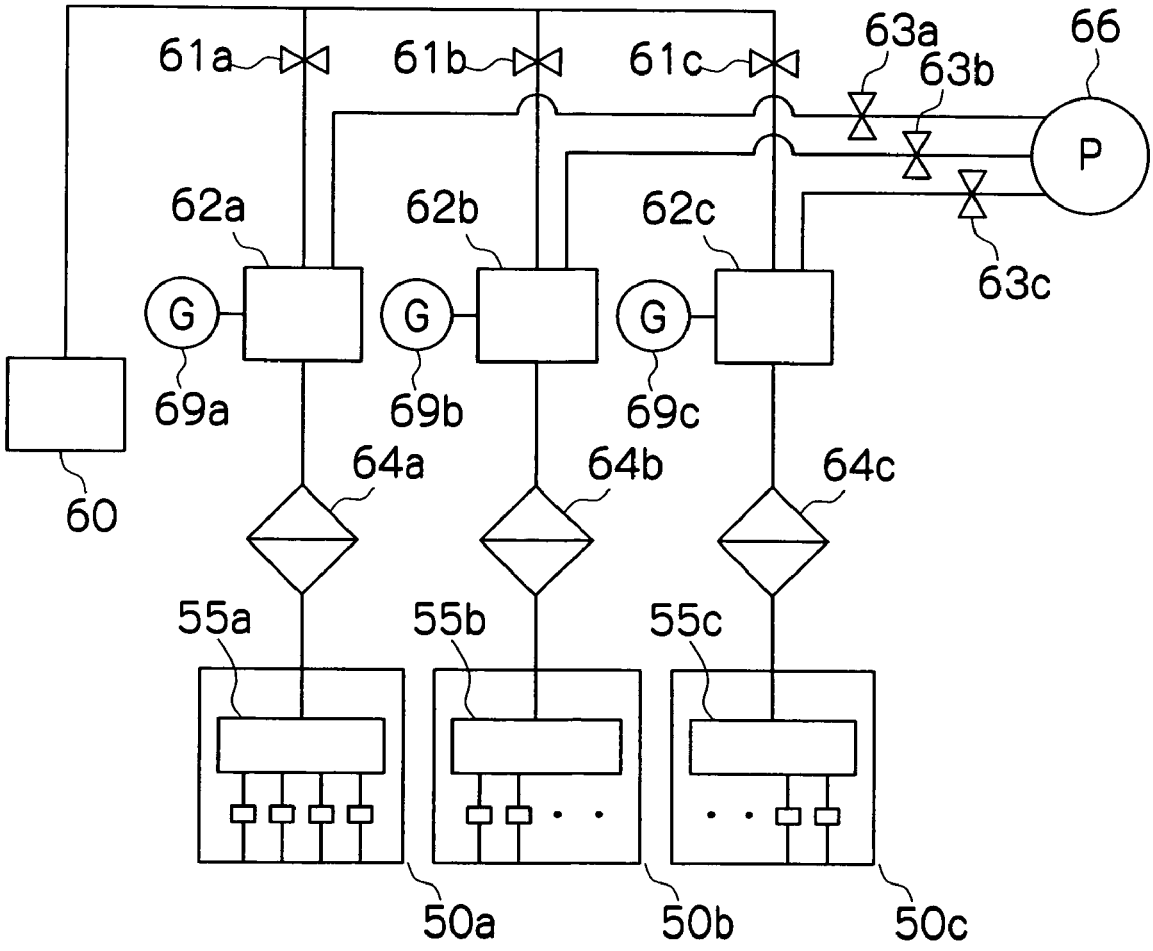
FIG. 12 is a conceptual diagram similarly showing an example where the movement of the boundary surface of the ink is implemented by controlling the pressure of the ink.

Furthermore, as shown in FIG. 12, the inkjet head 50 may also be constituted by small heads 50*a*, 50*b*, and 50*c* composed by several nozzles. In this case, similarly to FIG. 10, subsidiary tanks 62*a*, 62*b*, and 62*c* are connected to respectively to the small heads 50*a*, 50*b*, 50*c*, and the pressure gauges 69*a*, 69*b*, 69*c* are provided in the respective subsidiary tanks 62*a*, 62*b*, 62*c*, and hence the pressure applied to the ink in the respective subsidiary tanks 62*a*, 62*b*, and 62*c* can be controlled by means of a single pump 66.

Figure 13:
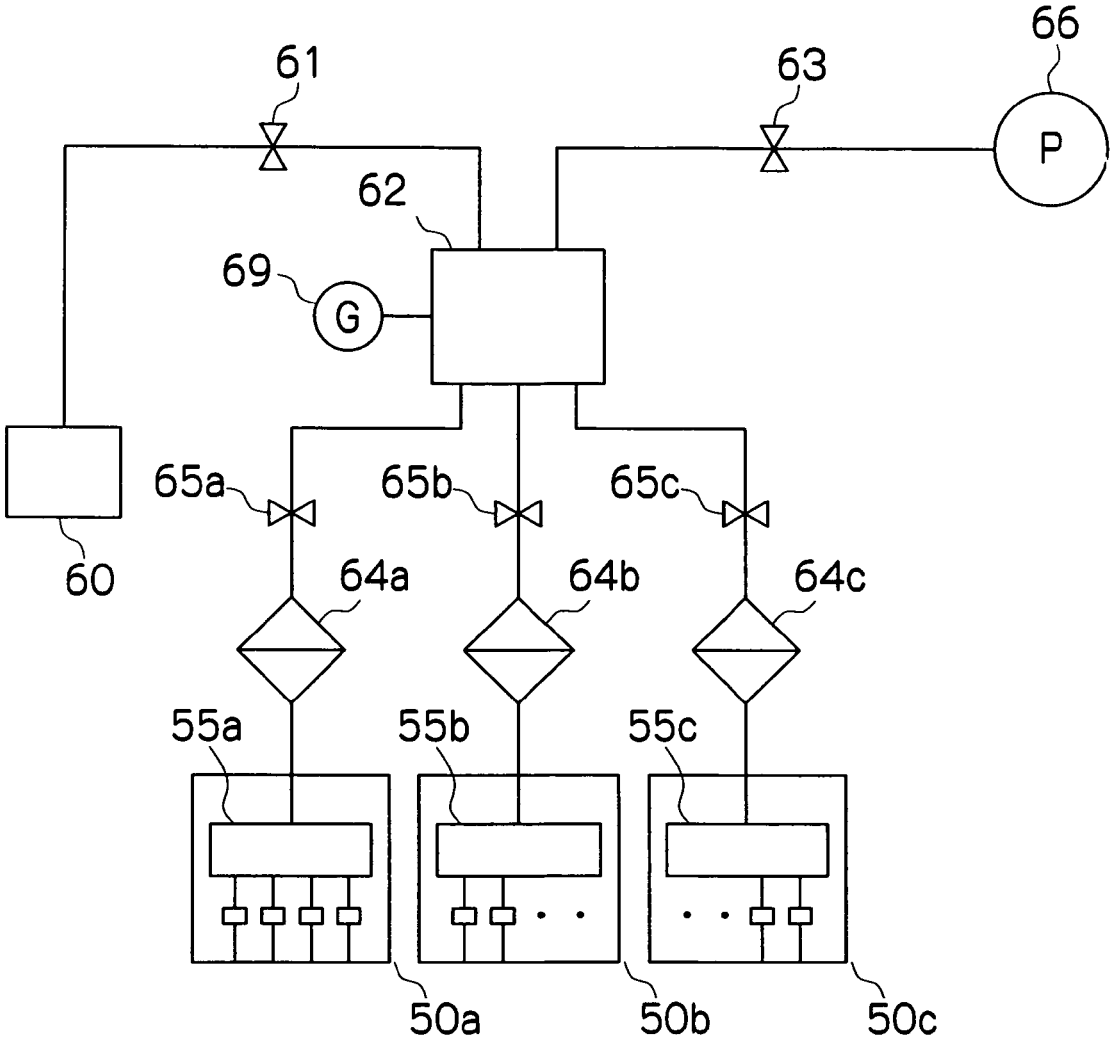
FIG. 13 is a conceptual diagram, similarly showing an example wherein the movement of the boundary surface of the ink is implemented by controlling the pressure of the ink.

Furthermore, even if the inkjet head 50 is constituted by small heads 50*a*, 50*b*, and 50*c* which consist of several nozzles, then as shown in FIG. 13, the respective small heads 50*a*, 50*b*, and 50*c* may share the use of the subsidiary tank 62.

Figure 14:
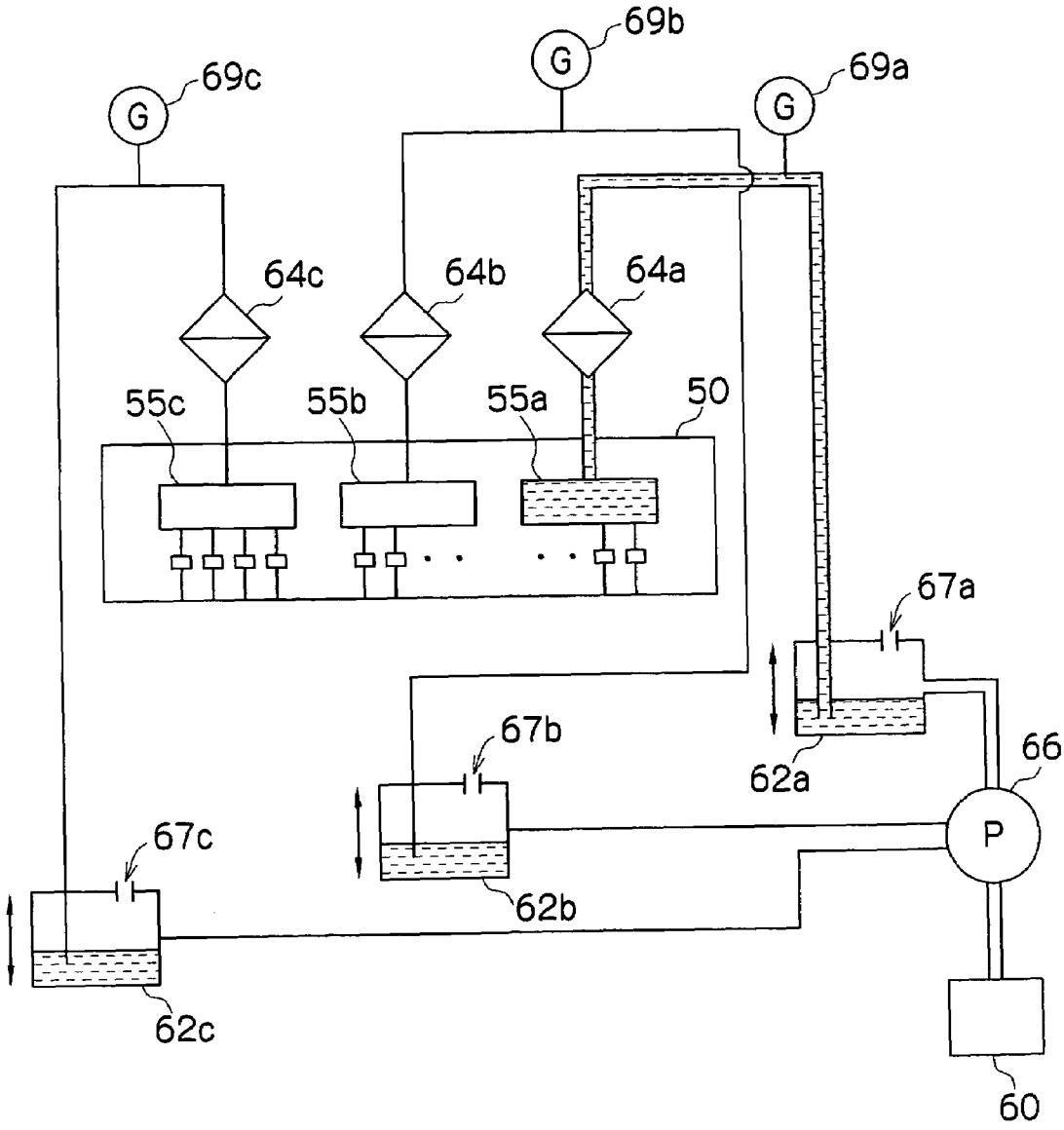
FIG. 14 is a conceptual diagram similarly showing an example where the movement of the boundary surface of the ink is implemented by controlling the pressure of the ink.

Moreover, as in the example shown in FIG. 12, if the inkjet head 50 is constituted by several small heads 50*a*, 50*b*, and 50*c*, and if subsidiary tanks 62*a*, 62*b*, and 62*c* are connected respectively to each of these small heads 50*a*, 50*b*, and 50*c*, then as shown in FIG. 14, it is also possible to control the pressure applied to the ink, by causing the positions of the respective subsidiary tanks 62*a*, 62*b*, and 62*c* to move upwards and downwards as indicated by the arrows in the diagram. In this case, the respective subsidiary tanks 62*a*, 62*b*, and 62*c* each have an opening that is open to the atmosphere 67*a*, 67*b*, and 67*c*, in such a manner that the pressure applied to the ink is controlled by upward and downward movement of the subsidiary tanks 62*a*, 62*b*, and 62*c* as indicated by the arrows in the diagram. The pressure gauges 69*a*, 69*b*, 69*c* for measuring the internal ink pressure are provided on the ink passages communicating with the subsidiary tanks 62*a*, 62*b*, 62*c*, respectively.

Furthermore, cleaning is possible, even during image formation, by carrying out a cleaning operation for raising and lowering the boundary surface of the ink, for each nozzle or each block, independently, and hence productivity can be increased. Moreover, this cleaning operation can be carried out appropriately, immediately before image recording, or during image recording, or between image recording operations, by raising or lowering the meniscus of the ink for a short period of time.

Figure 15:
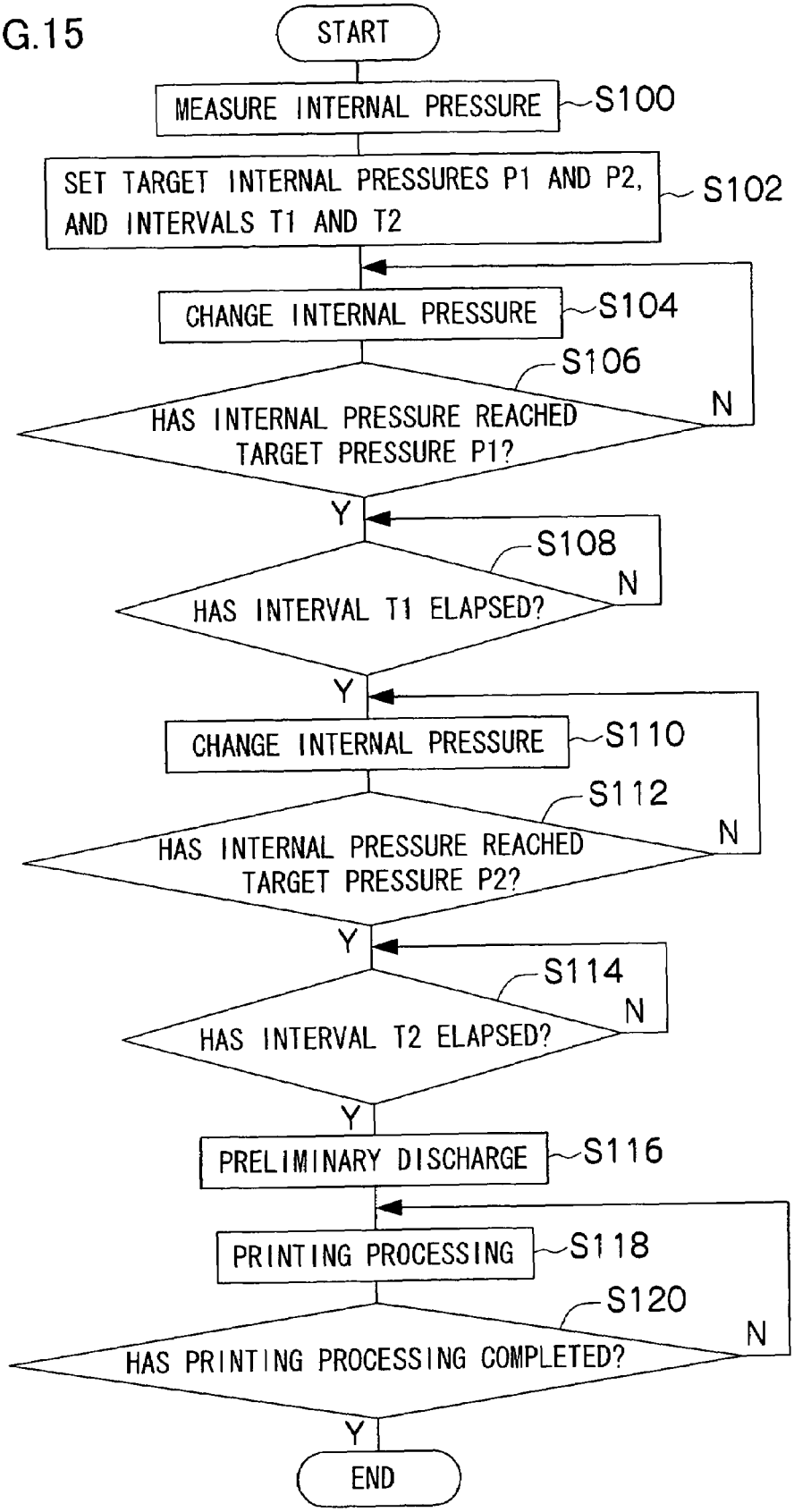
FIG. 15 is a flowchart illustrating a method of cleaning the inkjet head.
Figure 16A:
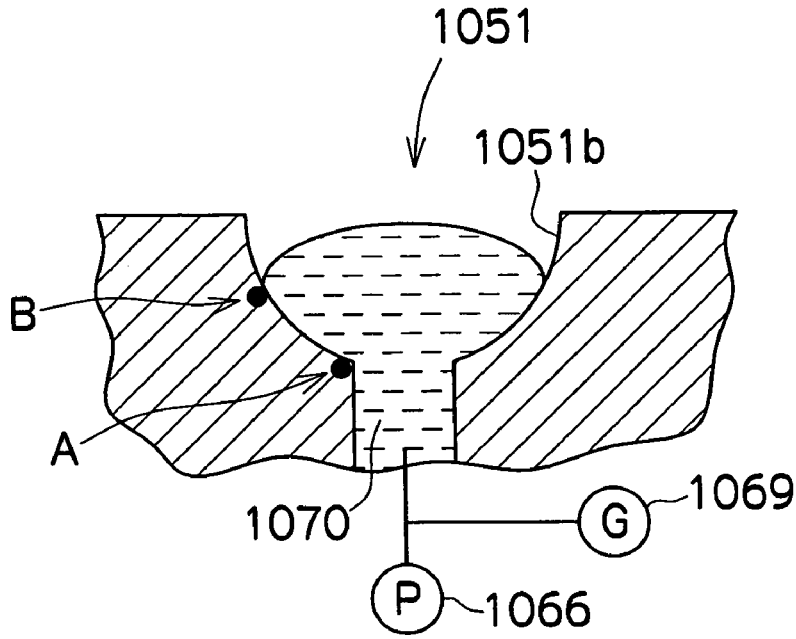
FIGS. 16A and 16B are sectional views illustrating control of the ink boundary surface in the nozzle.
Figure 16B:
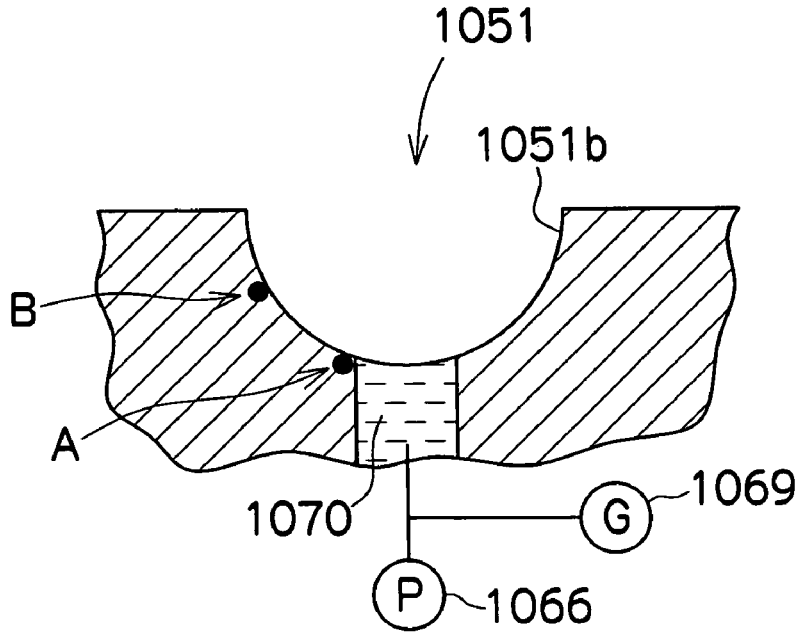

Next, a procedure for performing image recording after cleaning the inkjet head will be described with reference to a flowchart in FIG. 15. FIG. 15 is a flowchart illustrating the procedures of an inkjet head cleaning method. FIGS. 16A and 16B are sectional views showing the position of the ink boundary surface in the nozzle. The flowchart in FIG. 15 will be described gradually below while referring also to FIGS. 16A and 16B.

First, in step S100 of FIG. 15, the internal pressure of ink 1070 inside a nozzle 1051 is measured by a pressure gauge 1069 (see FIGS. 16A and 16B). Next, in step S102, a target internal pressure P1 required to hold the boundary surface of the ink 1070 at the position of the second clip point B on an ink discharge port side 1051*b* of the nozzle 1051 and a target internal pressure P2 required to hold the boundary surface of the ink 1070 at the position of the first clip point A are set, and intervals T1 and T2 for holding the respective target internal pressures P1 and P2 are set.

Next, in step S104, a pump 1066 is driven to change the internal ink pressure, and in step S106, the internal pressure is measured by the pressure gauge 1069 to determine whether or not the internal pressure has reached the target value P1 set above. If, as a result of the determination, the target value P1 has not been reached, the routine returns to step S104 and continues to drive the pump 1066 to further change the internal pressure.

Once the internal pressure has reached the target value P1, a determination is made in a following step S108 as to whether or not the interval T1 has elapsed following the internal pressure reaching the target value P1. The internal pressure is held at the target value P1 until the interval T1 elapses. Thus, as shown in FIG. 16A, the ink boundary surface is held in the position of the second clip point B for the duration of the interval T1.

After holding the internal ink pressure at the target value P1 for the duration of the interval T1, the pump 1066 is driven to change the internal ink pressure in step S10, and in step S112, the internal ink pressure is measured by the pressure gauge 1069 to determine whether or not the internal ink pressure has reached the target value P2.

Once the internal ink pressure has reached the target value P2, a determination is made in step S114 as to whether or not the interval T2 has elapsed, and the internal ink pressure is held at the target value P2 until the interval T2 elapses. In so doing, foreign matter adhered to the incline on the outlet side of the nozzle inner wall surface can be recovered.

Once the internal ink pressure has been held at the target value P2 for the duration of the interval T2, preliminary discharge is performed in a following step S116 to discharge the ink containing the fouling to a purge receptacle, whereby the fouling is removed. This is the manner in which head cleaning is performed.

After the head has been cleaned, image recording (printing) is executed in step S118 by discharging ink from the print head onto a recording medium. In step S120, a determination is made as to whether printing processing has been completed for all of the image data to be recorded. When image data remain, printing is continued, and when printing ends, all processing ends.

Cleaning of the inkjet head may be executed simply by performing the processing from step S100 to step S114 or from step S100 to step S116 in the flowchart in FIG. 15, irrespective of the printing operation.

The inkjet head and the method of cleaning an inkjet head according to the present invention are described above in detail, but the present invention is not limited to the aforementioned examples. It is also possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet head comprising:

a nozzle which discharges droplets of ink through an ink discharge port to perform recording onto a recording medium, the ink being supplied through a supply duct, at least partial cross section of the nozzle on a side of the ink discharge port broadening toward the ink discharge port; and a device which moves a position of a boundary surface of the ink between a first boundary surface keeping position inside the nozzle at which the boundary surface of the ink is kept for recording and a second boundary surface keeping position inside the nozzle at which the boundary surface of the ink is kept for cleaning the nozzle under pressure less than or equal to ink discharging pressure, wherein fouling around the nozzle is collected by moving the position of the boundary surface of the ink between the first boundary surface keeping position and the second boundary surface keeping position, and one of a step and a groove is formed in a portion of an inner wall of the nozzle, a cross section of the portion being formed so as to broaden toward the ink discharge port.

2. The inkjet head as defined in claim 1, wherein the device for moving the position of the boundary surface of the ink moves the position of the boundary surface of the ink by controlling internal pressure of the ink.

3. The inkjet head as defined in claim 1, wherein the inkjet head comprises a plurality of nozzles formed in a plurality of blocks, the inkjet head further comprising:

a discharging actuator which actuates the nozzle to discharge the droplets of the ink, wherein the position of the boundary surface of the ink inside the nozzle is moved for each nozzle or each block of nozzles by using the discharging actuator as the device for moving the position of the boundary surface of the ink.

4. The inkjet head as defined in claim 1, further comprising:

a preliminary ink discharging mechanism, wherein preliminary discharging of the ink is implemented after the fouling around the nozzle is collected by moving the position of the boundary surface of the ink.

5. The inkjet head as defined in claim 4, wherein the preliminary discharge of the ink is implemented according to dirtiness of the nozzle.

6. An inkjet head comprising:

a nozzle which discharges droplets of ink through an ink discharge port to perform recording onto a recording medium, the ink being supplied through a supply duct, at least partial cross section of the nozzle on a side of the ink discharge port broadening toward the ink discharge port; and a device which moves a position of a boundary surface of the ink between a first boundary surface keeping position inside the nozzle at which the boundary surface of the ink is kept for recording and a second boundary surface keeping position inside the nozzle at which the boundary surface of the ink is kept for cleaning the nozzle under pressure less than or equal to ink discharging pressure, wherein fouling around the nozzle is collected by moving the position of the boundary surface of the ink between the first boundary surface keeping position and the second boundary surface keeping position, and an inner wall of the nozzle is formed so as to have three contact angles with respect to the ink, the contact angles gradually increasing from ink supply side to ink discharge side.

7. A method of cleaning an inkjet head for removing fouling around a nozzle of the inkjet head discharging through an ink discharge port onto a recording medium droplets of ink supplied through a supply duct to perform recording, comprising:

forming the nozzle such that at least a partial cross section of the nozzle on a side of an ink discharge port broadens toward the ink discharge port; and collecting fouling around the nozzle by moving a position of a boundary surface of the ink between a first boundary surface keeping position inside the nozzle at which the boundary surface of the ink is kept for recording and a second boundary surface keeping position inside the nozzle at which the boundary surface of the ink is kept for cleaning the nozzle under pressure less than or equal to ink discharging pressure, wherein one of a step and a groove is formed in a portion of an inner wall of the nozzle, a cross section of the portion being formed so as to broaden toward the ink discharge port.

8. The method as defined in claim 7, wherein the position of the boundary surface of the ink is moved by controlling internal pressure of the ink.

9. The method as defined in claim 7, wherein the inkjet head comprises a plurality of nozzles formed in a plurality of blocks, and the position of the boundary surface of the ink inside the nozzle is moved for each nozzle or each block of nozzles by using a discharging actuator for actuating the nozzle to discharge the droplets of the ink.

10. The method as defined in claim 7, further comprising implementing preliminary discharging of the ink after the fouling around the nozzle is collected by moving the position of the boundary surface of the ink.

11. The method as defined in claim 10, wherein the preliminary discharge of the ink is implemented according to dirtiness of the nozzle.

12. A method of cleaning an inkjet head for removing fouling around a nozzle of the inkjet head discharging onto a recording medium droplets of ink supplied through a supply duct to perform recording, comprising:

forming the nozzle such that at least a partial cross section of the nozzle on a side of an ink discharge port broadens toward the ink discharge port; and collecting fouling around the nozzle by moving a position of a boundary surface of the ink between a first boundary surface keeping position inside the nozzle at which the boundary surface of the ink is kept for recording and a second boundary surface keeping position inside the nozzle at which the boundary surface of the ink is kept for cleaning the nozzle under pressure less than or equal to ink discharging pressure, wherein an inner wall of the nozzle is formed so as to have three contact angles with respect to the ink, the contact angles gradually increasing from ink supply side to ink discharge side.

* * * * *